US005940112A

United States Patent [19]

Siwinski

[11] Patent Number: 5,940,112

[45] Date of Patent: Aug. 17, 1999

[54] TEMPORARY TAKE-UP DRUM FOR REMOVING CURL FROM ROLLED RECEIVER PAPER

[75] Inventor: Michael J. Siwinski, Rochester, N.Y.

[73] Assignee: Eastman Kodak Company, Rochester, N.Y.

[21] Appl. No.: 09/049,301

[22] Filed: Mar. 27, 1998

[51] Int. Cl.[6] ..... B41J 2/32

[52] U.S. Cl. ..... 347/218; 347/187

[58] Field of Search ..... 347/218, 172, 347/174, 176, 187; 400/719, 120.08

[56] References Cited

U.S. PATENT DOCUMENTS

| | | | |
|---|---|---|---|
| 3,552,668 | 1/1971 | Kanno . | |
| 3,806,574 | 4/1974 | Arvidson, Jr. . | |
| 4,505,695 | 3/1985 | Billings . | |
| 4,710,041 | 12/1987 | Shimada et al. | 347/176 |
| 5,533,821 | 7/1996 | Awai et al. . | |
| 5,549,864 | 8/1996 | Greene et al. . | |
| 5,580,588 | 12/1996 | Greene et al. . | |
| 5,637,070 | 6/1997 | Sasai . | |

FOREIGN PATENT DOCUMENTS

| | | | |
|---|---|---|---|
| 2-000538 | 1/1990 | Japan | 347/187 |

*Primary Examiner*—Huan Tran
*Attorney, Agent, or Firm*—Davis & Kendall

[57] ABSTRACT

Temporary take-up drum for removing curl from rolled receiver paper. A thermal printer mechanism arrangement with a thermal printer head (9), a paper supply roll (11), and a temporary print take-up drum (12). The paper supply roll (11) rolls in a direction allowing the paper (13) to pass between the thermal printer head (9) and the platen roller (10). A temporary take-up drum (12) receives the receiver paper (13) and rotates in a direction opposite from that of the paper supply roll (11).

19 Claims, 3 Drawing Sheets

TEMPORARY TAKE-UP DRUM FOR REMOVING CURL FROM ROLLED RECEIVER PAPER

FIELD OF THE INVENTION

This invention relates to thermal printer mechanisms and more specifically to the receiver paper and thermal printer head arrangement within a thermal printer. Still more particularly it relates to a process for removing curl from receiver paper and reducing the size of a thermal printer.

BACKGROUND OF THE INVENTION

Thermal dye printers typically use precut dye print receiver media sheets. This is so because rolled receiver paper leave a curl in the finished paper. The current trend in consumer electronics is to produce cheaper, smaller, and lighter products for the consumer market. The emphasis being to develop products that are smaller then those produced in the past. FIG. 1 shows a conventional multi-pass thermal printer layout. The length or footprint of the thermal printer is primarily determined by the configuration of the sheet feed tray to the thermal printer head. The printer requires a paper supply tray and a temporary storage area at least the size of the paper to accommodate the multiple print passes of the print in process. This requirement for a paper supply tray and a temporary storage area adds to the overall length and weight of thermal printers.

U.S. Pat. No's. 4,505,695, 5,533,821, and 5,637,070 disclose sheet decurling mechanisms. They disclose complex mechanical devices having multiple belts and rollers which is subject to frequent mechanical break-downs and their complex designs add to the cost of the thermal printer. Additionally, these arrangements do not accommodate both a forward and reverse direction of the receiver paper.

Arvidson, in U.S. Pat. No. 3,806,574 discloses a method of decurling flat photographic sheets. Arvidson teaches the use of reverse rewinding of rolled sheets to decurl photographic film. The process of winding, rewinding and holding the film does not contemplate the high speeds and rates associated with thermal printing. To apply the process as disclosed by Arvidson would significantly slow-down the page per minute (ppm) requirements of today's consumer.

Green et al. in U.S. Pat. No's. 5,549,864, and 5,580,588 disclose a process for decurling a strip of photosensitive material. The method and apparatus as claimed is to a complex configuration incorporating a series of twists and bends to bring about the desired result. Additionally, U.S. Pat. No. 3,552,668 discloses a curl removing device which uses pressure from a series of rollers to remove the curl. The methods and apparatus as disclosed above are not conducive for multi-pass printing and add size and weight to thermal printers.

SUMMARY OF THE INVENTION

The present invention as disclosed herein overcomes the problems associated with thermal printers as set forth above. The invention uses a paper supply roll and a temporary print take-up drum to feed and decurl the receiver paper. The invention uses clockwise and counterclockwise rotation of the paper supply roll and temporary take-up drum to wind the receiver paper in an opposite direction from that while stored on the paper supply roll. The invention significantly reduces the size and weight of the thermal printer, in that it need only have the paper at the nip exposed during the print-in-process. Therefore, there is no requirement for a full length supply tray nor an area the length of a cut sheet to accommodate a temporary storage area. More importantly, the invention provides a less complex means to decurl the receiver paper during printing. As a result, the invention as disclosed herein is able to deliver a thermal printer having a configuration with both a forward printing and reverse action for eliminating the curl from a rolled receiver paper. The printer mechanism is lower in cost and smaller in size.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

There may be additional structures described in the foregoing application which are not depicted on one of the described drawings. In the event such a structure is described but not depicted in a drawing, the absence of such a drawing should not be considered as an omission of such design from the specification.

DETAILED DESCRIPTION OF THE INVENTION

Figure 1:
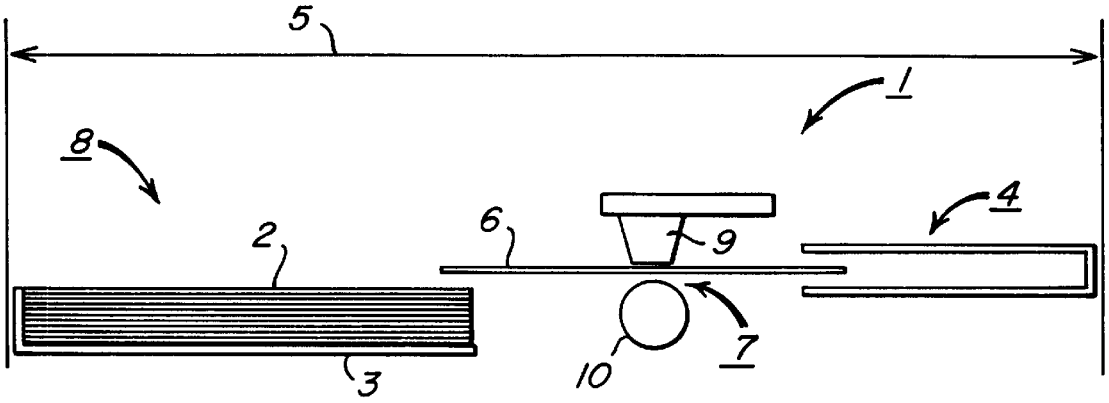
FIG. 1 rendering of a prior art printer configuration.

Referring to FIG. 1, a traditional thermal printer configuration (1) using a multi-pass print method has a thermal print head arrangement having a sheet fed paper supply (2) of cut sheet receiver paper in a supply tray (3). In addition, the arrangement requires a temporary print-in-process area (4) to accommodate the receiver paper length. This severely limits the minimum length of the printer footprint (5). In operation, the cut sheet receiver paper (6) is moved forward through the printing nip (7) into the temporary print-in-process storage area (4) during printing. The cut sheet receiver paper (6) is then pulled backwards out of the temporary print-in-process storage area (4) and back into an area (8) above the paper supply tray (3) during printing passes. As shown in FIG. 1, as the cut sheet receiver paper (6) is pulled backwards, an area (8) at least the length of the receiver paper is needed to nest the receiver paper until the final print pass is completed.

Figure 2:
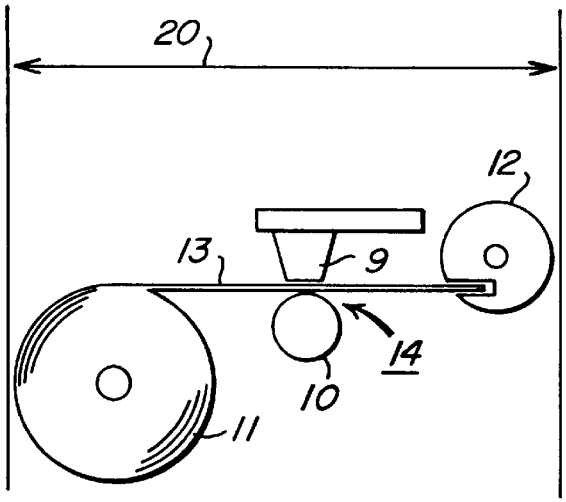
FIG. 2 shows a side view of the first embodiment of the invention.
Figure 3:
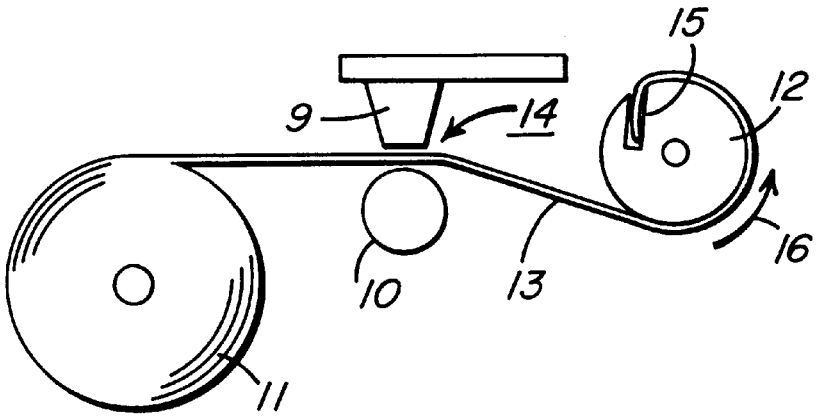
FIG. 3 shows a side view of the first embodiment of the invention.

FIGS. 2 and 3 show the invention having a thermal printer mechanism arrangement with a thermal printer head (9), a paper supply roll (11), and a temporary print take-up drum (12). The paper supply roll (11) is shown rolling in a direction allowing the paper (13) to pass between the thermal printer head (9) and the platen roller (10). A temporary take-up drum (12) receives the receiver paper (13) and rotates in a direction opposite from that of the paper supply roll (11). This imparts tension in an opposite direction from that of the supply roll (11) and causes the receiver paper (13) to straighten as it passes across the thermal printer head (9). In addition, the foot print (20) of the thermal printer is significantly reduced.

Using roll-fed receiver paper (13) can produce prints that have an objectional curl. The temporary print take-up drum (12) as shown in FIG. 3 will wind the receiver paper (13) during the print-in-process in a direction that is opposite to the direction that the receiver paper (13) was stored on the receiver supply roll (11). This reverse winding will undo some or all of the curl that the receiver paper has developed while stored on the paper supply roll (11). The thermal printing process is a 4-pass process, the receiver paper (13) will be wound around the take-up drum (12) four times during the print-in-process. The blank receiver paper is fed off of the supply roll (11), through the printing nip (14), and into the receiving slot (15) in the temporary take-up drum (12). During printing, the receiver paper (13) is wound around the temporary take-up drum (12) in a reverse-curl direction (16). The amount of uncurling can be adjusted by design. A smaller take-up drum will wind the receiver paper during the print-in-process into a smaller diameter wind, and will produce a more pronounced uncurling action.

Figure 4:
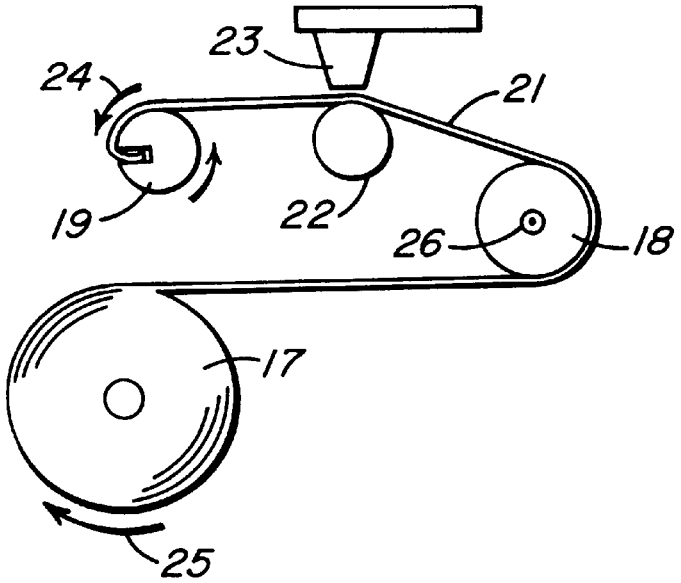
FIG. 4 shows a side view of the second embodiment of the invention.

FIG. 4 shows an alternative embodiment of the invention having a supply receiver paper roll (17), a guide roller (18), and a temporary take-up drum (19). This configuration contemplates having the receiver paper (21) feed around the guide roller (18), and passing between the platen (22) and thermal printer head (23) to the temporary take-up drum (19). The temporary take-up drum (19) is in the same plane as the supply paper roll (17) and rotates in an opposite direction (24) to the supply roll direction (25). Additionally, the guide roller (18) may contain a heating element (26). This heating element would presoften the receiver paper (21) whereby the heat emitted by the thermal printer head (23) would cause a straightening effect and further relax the receiver paper (21).

Figure 5:
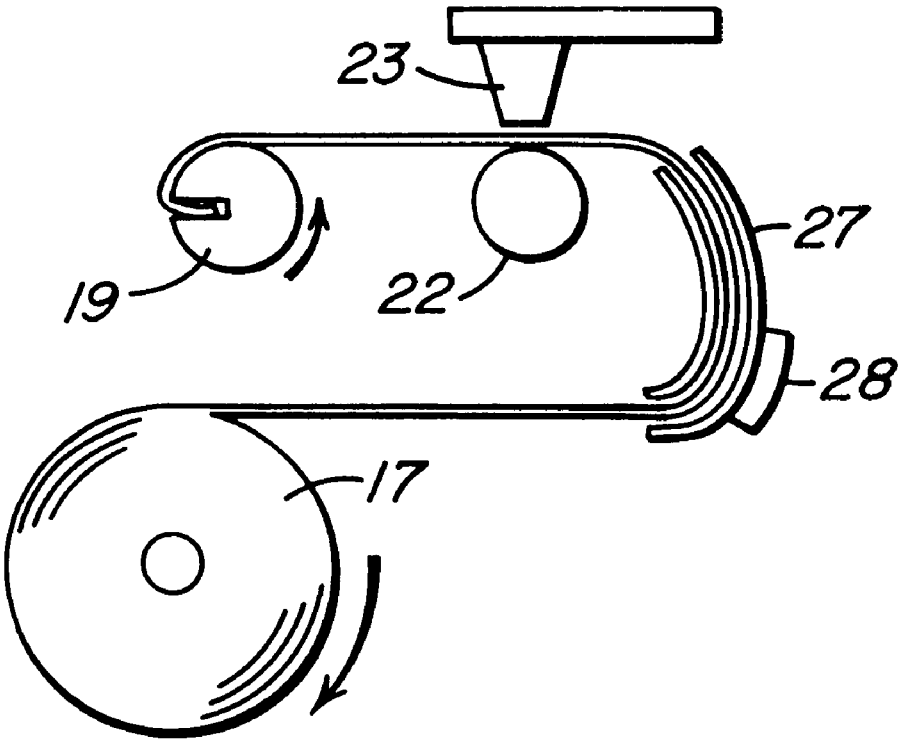
FIG. 5 shows a side view of the third embodiment of the invention.

FIG. 5 shows another alternative embodiment whereby the guide roller (18) is replaced with a guide (27). This guide may also incorporate a heating element to presoften the receiver paper (28).

Further modification and variation can be made to the disclosed embodiments without departing from the subject and spirit of the invention as defined in the following claims. Such modifications and variations, as included within the scope of these claims, are meant to be considered part of the invention as described.

PARTS LIST

1. Thermal printer configuration
2. Paper supply
3. Paper supply tray
4. Print-in-process area
5. Printer footprint
6. Receiver paper
7. Printing nip
8. Area above paper supply tray
9. Thermal printer head
10. Platen roller
11. Paper supply roll
12. Temporary take-up drum
13. Receiver paper
14. Nip
15. Receiving slot
16. Reverse-curl direction
17. Paper roll
18. Guide roller
19. Temporary take-up drum
20. Footprint
21. Receiver paper
22. Platen roller
23. Thermal printer head
24. Opposite direction
25. Supply roll direction
26. Heating element
27. Guide
28. Heating element

What is claimed is:

1. A thermal printer apparatus having a thermal print head and a reciprocating receiver path comprising:

a rolled receiver paper defining a first axis of rotation therethrough, said rolled receiver paper having a curl;

said rolled receiver paper rotating in a first direction about the first axis of rotation and advancing across said thermal print head and a platen roller;

a heater element in heat transfer communication with said rolled receiver paper to presoften said rolled receiver paper; and a storage device attached to said rolled receiver paper, said storage device defining a second axis of rotation therethrough and rotating in a second direction opposite the first direction, whereby when said rolled receiver paper advances, said storage device imparts tension to said rolled receiver paper and said heater element presoftens the rolled receiver paper, so that the tensioning and the presoftening are sufficient to decurl said rolled receiver paper during a print-in-process.

2. The thermal printer apparatus as recited in claim 1, wherein said storage device is a drum defining the second axis of rotation.

3. The thermal printer apparatus as recited in claim 2, wherein when said rolled receiver paper rotates in the first direction, said drum rotates in the second direction keeping said rolled receiver paper straight as said rolled receiver paper advances across said thermal print head.

4. The thermal printer apparatus as recited in claim 1, further comprising a guide roller which causes said rolled receiver paper to advance across said thermal print head.

5. The thermal printer apparatus as recited in claim 4, wherein said storage device is positioned in the same plane as said rolled receiver paper.

6. The thermal printer apparatus as recited in claim 5, wherein said storage device comprises a drum having the ability to rotate in either a clockwise or counterclockwise motion.

7. The thermal printer apparatus as recited in claim 1, wherein said heater element is connected to a guide roller to presoften said rolled receiver paper.

8. The thermal printer apparatus as recited in claim 1, further comprising a paper guide which causes said rolled receiver paper to advance across said thermal print head.

9. The thermal printer apparatus as recited in claim 8, wherein said storage device is positioned in the same plane as said rolled receiver paper.

10. The thermal printer apparatus as recited in claim 9, wherein said storage device comprises a drum having the ability to rotate in either a clockwise or counterclockwise motion.

11. The thermal printer apparatus as recited in claim 10, wherein said paper guide includes said heater element to presoften said rolled receiver paper.

12. A method of removing curl from rolled receiver paper in a thermal printer apparatus during a multi-pass printing process, comprising the steps of:

(a) advancing a rotatable rolled receiver paper across a thermal print head and a platen roller, the rolled receiver paper defining a first axis of rotation therethrough, the rolled receiver paper rotating in a first direction about the first axis of rotation;

(b) disposing a heater element into heat transfer communication with the rolled receiver paper to presoften the rolled receiver paper; and (c) attaching a storage device to the rolled receiver paper, the storage device defining a second axis of rotation therethrough and rotating in a second direction opposite the first direction, whereby when the rolled receiver paper advances across the thermal print head the storage device imparts tension to the rolled receiver paper and the heater presoftens the rolled receiver paper, so that the tensioning and presoftening causes the rolled receiver paper to decurl as the rolled receiver paper advances across the thermal print head.

13. The method of claim 12, wherein the step of attaching a storage device comprises the step of attaching a rotatable drum having an ability to rotate in either a clockwise or counterclockwise motion.

14. The method of claim 13, wherein when the rolled receiver paper rotates in the first direction, the drum rotates in the second direction keeping the rolled receiver paper straight as the rolled receiver paper advances across the thermal print head during the multi-pass printing process.

15. The method of claim 12, wherein the step of attaching a storage comprises the step of positioning the storage device in the same plane as the rolled receiver paper.

16. The method of claim 15, wherein the step of advancing the rolled receiver paper across the thermal printer head comprises the step of providing a guide roller which causes the rolled receiver paper to advance across the thermal print head.

17. The method of claim 12, wherein the step of disposing a heater element comprises the step of connecting a heater element to a guide roller to presoften the rolled receiver paper.

18. The method of claim 12, wherein the step of advancing the rolled receiver paper across the thermal printer head comprises the step of providing a paper guide which causes the rolled receiver paper to advance across the thermal print head.

19. The method of claim 11, wherein the step of providing a paper guide comprises the step of providing a paper guide including a heater element to presoften the rolled receiver paper.

* * * * *